United States Patent [19]

Schüller et al.

[11] Patent Number: 4,754,238

[45] Date of Patent: Jun. 28, 1988

[54] MICROWAVE ABSORBER USING GASEOUS COOLING FLUID

[75] Inventors: Paul G. Schüller, Stuttgart; Rolf Wilhelm, Calw-Stammheim, both of Fed. Rep. of Germany

[73] Assignee: Max-Planck-Gesellschaft zur Foerderung der Wissenschaften e.V., Fed. Rep. of Germany

[21] Appl. No.: 932,935

[22] Filed: Nov. 20, 1986

[30] Foreign Application Priority Data

Apr. 14, 1986 [DE] Fed. Rep. of Germany ... 8610138[U]

[51] Int. Cl.[4] ..... H01P 1/26

[52] U.S. Cl. ..... 333/22 F; 333/248

[58] Field of Search ..... 333/22 R, 22 F

[56] References Cited

U.S. PATENT DOCUMENTS

| | | | |
|---|---|---|---|
| 3,036,280 | 5/1962 | Woodcock | 333/22 R |
| 3,983,356 | 9/1976 | Jurgensen | 333/22 F X |
| 4,593,259 | 6/1986 | Fox et al. | 333/22 F |

*Primary Examiner*—Paul Gensler

*Attorney, Agent, or Firm*—Henry C. Nields

[57] ABSTRACT

A microwave absorber with a microwave-absorbing material, a protective housing surrounding this, and a waveguide leading into the protective housing, through which waveguide the microwaves to be absorbed can be conducted to the absorbing material, the microwave-absorbing material forming a solid body with a hollow, on one side of which the waveguide opens, a termination element being arranged on the side of the hollow opposite to the waveguide, and the housing being provided with an inlet and an outlet for a cooling fluid.

12 Claims, 1 Drawing Sheet

MICROWAVE ABSORBER USING GASEOUS COOLING FLUID

BACKGROUND OF THE INVENTION

1. Field of the Invention

The present invention relates to a microwave absorber with a microwave-absorbing material, a protective housing surrounding this, and a waveguide leading into the protective housing, through which waveguide the microwaves to be absorbed can be conducted to the absorbing material.

2. Description of the Prior Art

In the operation of high-frequency high-power generators in the microwave region (e.g. gyrotrons) reflection-free loads are necessary for the absorption of the radiation energy, on the one hand in order to optimize the operational parameters with respect to wave form and power, and on the other hand in order to be able to measure the power.

Up to now there have been used for this purpose water loads with water as absorber and cooling medium: see, e.g., U.S. Pat. No. 4,593,259. With increasing frequency the depth of penetration of the electromagnetic waves continuously falls off, so that in the case of millimeter waves at last only surface absorption occurs. At high power this can lead to formation of bubbles and to boiling of the water. This results in a strong reflection of the power, whereby under certain circumstances the generator or the load or both can be damaged. Therefore, especially for optimization of the operational parameters of the generator, one must work with relatively large water throughput (e.g. 500 l/min), in order to carry away any bubbles which may arise in the stream. In most cases, however, this is expensive and impractical.

SUMMARY OF THE INVENTION

The present invention deals with the problem of providing a simple at-hand and extremely reflection-poor absorber for microwaves, especially for millimeter waves.

A microwave absorber according to one embodiment of the invention includes a hollow body consisting of microwave-absorbing material which is arranged in a housing or a screen; in the hollow of this hollow body is conducted a microwave-conductor through the wall of the container. The container is provided with at least one inlet and outlet for a preferably gaseous cooling fluid which streams through the container and carries away the microwave energy which has been absorbed from the absorbing body. The flow of cooling fluid is maintained by a device which overcomes flow-resistance, e.g. by a pump or a fan.

In a particularly advantageous embodiment the housing which surrounds the absorbing body is prepared out of a material inpenetrable by microwaves, in which the inlets and outlets for the cooling medium are covered with material impenetrable by microwaves, so that entry of microwave radiation through the inlets and outlets of the container is hindered.

Preferably, furthermore, the symmetry of the absorbing body corresponds to the symmetry of the wave-type to be absorbed.

In a particularly advantageous embodiment a high-temperature-stable ceramic material, particularly fireclay, is used as the absorbing body.

Hereinafter preferred examples of embodiments of the invention are explained in more detail with reference to the drawing.

DESCRIPTION OF THE PREFERRED EMBODIMENTS

Figure 1:
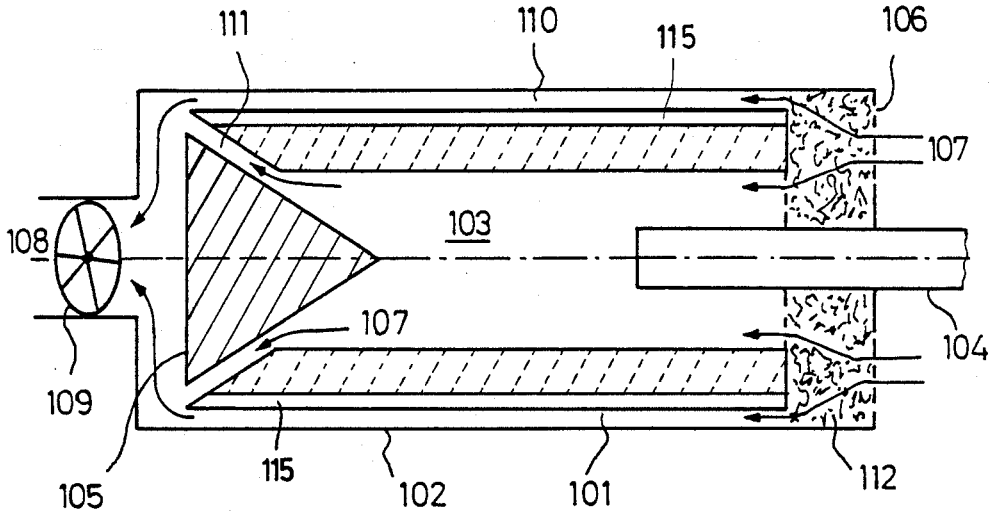
FIG. 1 shows a section through a microwave absorber according to a first embodiment of the invention.

Referring to the drawing, FIG. 1 shows a section through a microwave absorber which is constructed in essentially cylindrically symmetry for axially symmetric TE/on-modes. A hollow cylinder (101) prepared from a microwave-absorbing fire-clay is located in a cylindrical screen-housing (102) prepared from stainless steel. Into the hollow space (103) of the absorbing body (101) protrudes coaxially a cylindrical, axially displaceable waveguide (104), which radiates the microwaves to be absorbed. At the end of the absorbing body (101) opposite the waveguide (104) there is located a termination element in the form of a cylindrically symmetrical metal reflector (105), which corresponds in form to the type of oscillation of the microwave radiation to be absorbed. The microwaves which enter through the waveguide (104) are distributed to the inner surface of the absorbing body (101) by reflection at the surface of the metal reflector (105) and there absorbed. The absorber-container (102) is provided with entrance openings (106) and an exit-opening (108), through which an air-stream (107) cooling the absorbing body (101) is produced by means of a fan (109). The air sucked in by the fan (109) passes through openings (106) in the walls of a chamber in the housing (102), which chamber forms a front wall of the housing and is filled with metal shavings (112), streams through the interior (103) of the absorbing body (101) as well as through an air-space (110) formed between the absorbing body (101) and the absorber housing (102) and thereby cools the inner and outer surfaces of the absorbing body (101). The air streaming through the interior (103) of the absorbing body (101) passes out through an annular space (111) between the absorbing body (101) and the metal reflector (105) and leaves the absorber housing (102), together with the air which has flowed through the annular space (110), through the air-outlet (108). The air stream (107) conducts away the heat arising through absorption of microwave radiation in the absorber (101). In order to increase the heat transfer, the inner and/or outer cylindrical surfaces of the absorber (101) can be provided with longitudinal grooves 115 for increasing the surface. The exit of microwave radiation from the absorber is hindered by the housing (102), which forms an essentially closed metal enclosure and consists of a microwave-impenetrable layer of metal shavings (112) in the region of the air-entrance openings (106). The exit of microwave radiation through the cooling-air exit (108) is hindered either by means of a suitable geometrical arrangement of the annular space (111) with respect to the metal enclosure, or by means of a further microwave-impenetrable layer (not shown) of metal shavings in the region of the air-exit opening (108).

Figure 2:
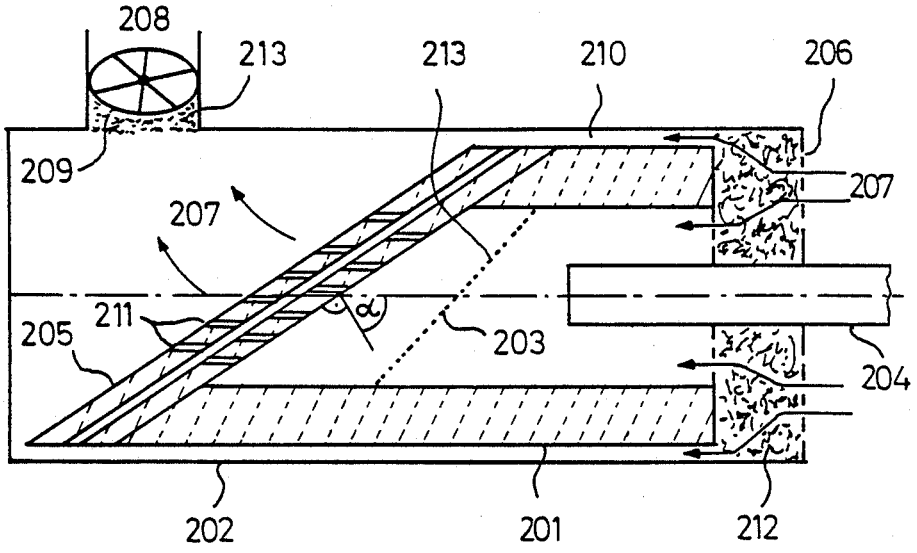
FIG. 2 shows a section through a microwave absorber according to a second embodiment of the invention.

In FIG. 2 there is shown a section through a microwave absorber for the absorption of linearly polarized radiation e.g. of TE/11 and HE/11 modes. An absorbing body (201) consisting of microwave-absorbing fire-clay is located in a housing (202) consisting of a metal enclosure. In the interior (203) of the absorbing body (201) there extends an axially displaceable waveguide (204), through which the microwave radiation to be absorbed is conducted. At the end of the absorber body opposite the waveguide there is positioned an absorber plate (205) manufactured also out of microwave-absorbing fire-clay at the Brewster-angle alpha. By means of this type of arrangement it is brought about that microwave radiation striking on the plate with corresponding oscillation-direction at the Brewster angle alpha enters into the absorbing material of the absorber plate (205) without reflection and is absorbed in this. For particular applications in order to bring it about that only linearly polarized radiation reaches the absorber plate (205), a polarization filter (213) can be arranged in the absorbing body (201) in front of the absorber plate (205), which reflects any non-linearly polarized portion of the radiation onto the inner surface of the absorber body (201), where it is absorbed. The housing (202) is provided with entrance openings (206) and an exit opening (208), between which an air stream (207) is maintained by the operation of a fan (209). A part of the air which enters at the entrance openings (206) streams through the interior (203) of the absorber body (201), and then leaves this through openings (211) of the absorber plate (205). Another part of the air entering through the entrance openings (206) flows about the absorbing body (201) through the gap (210) which surrounds this, so that the heat which is liberated during absorption of the microwave radiation is led away by the cooling-air stream (207) from the inner and outer surfaces of the absorbing body (201) and from the surface of the absorber plate (205). The exit of microwave radiation out of the absorber is hindered by the housing (202) consisting of a microwave-impenetrable metal enclosure surrounding the absorbing body (201). The wall of the housing (202) consists of a microwave-impenetrable layer of metal shavings (212) in the region of the air-entrance openings (206) and of a microwave-impenetrable layer of metal shavings (213) in the region of the air-exit opening (208).

Fire-clay is especially suitable as the solid, microwave-absorbing material, since it has a good absorption capability and is stable at high temperatures as well as capable of withstanding temperature changes. However, other microwave-absorbing solid materials can also be used, especially iron-oxide-containing rough ceramics. Instead of air, other cooling gases can also be used, such as e.g. hydrogen or helium, or even fluids which show a relatively small absorption capability for microwaves, so that the absorption occurs in the solid absorbing body in the first instance and some boiling of the fluid does not substantially influence the absorption properties of the absorber.

With a waveguide (104) having a circular cross-section and diameter (i.e. outer and inner diameters) of 63.4 mm and 27.8 mm respectively, a fire-clay cylinder (101) with an inner diameter of 160 mm and an outer diameter of 250 mm was used.

Having thus decribed the principles of invention, together with illustrative embodiments threof, it is to be understood that, although specific terms are employed, they are used in a generic and descriptive sense, and not for purposes of limitation, the scope of the invention being set forth in the following claims.

We claim:

1. Microwave absorber comprising, in combination, a solid body of microwave-absorbing material having a hollow therein, a protective housing surrounding said solid body, a waveguide extending through the protective housing and into said hollow at a first extremity thereof, said waveguide being adapted to conduct the microwaves to be absorbed to the absorbing material, and a termination element arranged at a second extremity of said hollow opposite to said first extremity, said housing being provided with an inlet and an outlet for a cooling fluid, wherein said protective housing forms a metal wrapping, and wherein said inlet as well as said outlet is provided with a seal which prevents exit of microwave radiation out of said metal wrapping.

2. Microwave absorber according to claim 1, wherein said solid body consists at least partly of fire-clay.

3. Microwave absorber comprising, in combination, a solid body of microwave-absorbing material having a hollow therein, a protective housing surrounding said solid body, a waveguide extending through the protective housing and into said hollow at a first extremity thereof, said waveguide being adapted to conduct the microwaves to be absorbed to the absorbing material, and a termination element arranged at a second extremity of said hollow opposite to said first extremity, said housing being provided with an inlet and an outlet for a cooling fluid, wherein said termination element comprises a microwave-reflecting material.

4. Microwave absorber comprising, in combination, a solid body of microwave-absorbing material having a hollow therein, a protective housing surrounding said solid body, a waveguide extending through the protective housing and into said hollow at a first extremity thereof, said waveguide being adapted to conduct the microwaves to be absorbed to the absorbing material, and a termination element arranged at a second extremity of said hollow opposite to said first extremity, said housing being provided with an inlet and an outlet for a cooling fluid, said microwave absorber having an essentially cylindrically symmetrical construction with respect to the axis of said waveguide.

5. Microwave absorber comprising, in combination, a solid body of microwave-absorbing material having a hollow therein, a protective housing surrounding said solid body, a waveguide extending through the protective housing and into said hollow at a first extremity thereof, said waveguide being adapted to conduct the microwaves to be absorbed to the absorbing material, and a termination element comprising a solid microwave-absorbing material arranged at a second extremity of said hollow opposite to first extremity, said housing being provided with an inlet and an outlet for a cooling fluid, wherein said termination element has the form of a plane-parallel plate, the normals whereof subtend the Brewster angle with the axis of said waveguide.

6. Microwave absorber comprising, in combination, a solid body of microwave-absorbing material having a hollow therein, a protective housing surrounding said solid body, a waveguide extending through the protective housing and into said hollow at a first extremity thereof, said waveguide being adapted to conduct the microwaves to be absorbed to the absorbing material, and a termination element arranged at a second extremity of said hollow opposite to said first extremity, said housing being provided with an inlet and an outlet for a cooling fluid, wherein said termination element is provided with openings for passage of said cooling fluid.

7. Microwave absorber comprising, in combination, a solid body of microwave-absorbing material having a hollow therein, a protective housing surrounding said solid body, a waveguide extending through the protective housing and into said hollow at a first extremity thereof, said waveguide being adapted to conduct the microwaves to be absorbed to the absorbing material, and a termination element comprising a solid microwave-absorbing material arranged at a second extremity of said hollow opposite to first extremity, said housing being provided with an inlet and an outlet for a cooling fluid, wherein said termination element has at least approximately the form of a cone with the tip directed towards said waveguide, which cone is separated from said solid body by at least one space.

8. Microwave absorber comprising, in combination, a solid body of microwave-absorbing material having a hollow therein, a protective housing surrounding said solid body, a waveguide extending through the protective housing and into said hollow at a first extremity thereof, said waveguide being adapted to conduct the microwaves to be absorbed to the absorbing material, and a termination element arranged at a second extremity of said hollow opposite to said first extremity, said housing being provided with an inlet and an outlet for a cooling fluid, said microwave absorber having a polarization filter arranged in said hollow between said waveguide and said termination element with such an angle between said waveguide and said termination element, that a predetermined polarized component of the microwaves entering through said waveguide are transmitted to said termination element, whereas other components are reflected on said solid body before striking on said termination element.

9. Microwave absorber comprising, in combination, a solid body of microwave-absorbing material having a hollow therein, a protective housing surrounding said solid body, a waveguide extending through the protective housing and into said hollow at a first extremity theroef, said waveguide being adapted to conduct the microwaves to be absorbed to the absorbing material, and a termination element arranged at a second extremity of said hollow opposite to said first extremity, said housing being provided with an inlet and an outlet for a cooling fluid, wherein said waveguide is arranged axially displaceable with respect to said housing.

10. Microwave absorber comprising, in combination, a solid body of microwave-absorbing material having a hollow therein, a protective housing surrounding said solid body, a waveguide extending through the protective housing and into said hollow at a first extremity thereof, said waveguide being adapted to conduct the microwaves to be absorbed to the absorbing material, and a termination element arranged at a second extremity of said hollow opposite to said first extremity, said housing being provided with an inlet and an outlet for a cooling fluid, said microwave absorber having a fan for the supply of gas as cooling fluid through said protective housing.

11. Microwave absorber comprising, in combination, a solid body of microwave-absorbing material having a hollow therein, a protective housing surrounding said solid body, a waveguide extending through the protective housing and into said hollow at a first extremity thereof, said waveguide being adapted to conduct the microwaves to be absorbed to the absorbing material, and a termination element arranged at a second extremity of said hollow opposite to said first extremity, said housing being provided with an inlet and an outlet for a cooling fluid, wherein said inlet and/or said outlet contains metal shavings as a seal against escape of microwave radiation.

12. Microwave absorber according to claim 11, wherein said housing is cylindrical and is provided with a chamber at a front wall through which said waveguide enters into said housing, which chamber has perforated walls and is filled with metal shavings.

* * * * *